US007234279B2

(12) United States Patent
Sincic et al.

(10) Patent No.: US 7,234,279 B2
(45) Date of Patent: Jun. 26, 2007

(54) MULTI-TUBE SKYLIGHT

(75) Inventors: Glen R. Sincic, Orlando, FL (US); James W. Feudner, Deltona, FL (US); Lovell B. Reed, Deltona, FL (US)

(73) Assignee: Sun-Tek Manufacturing Inc., Orlando, FL (US)

( * ) Notice: Subject to any disclaimer, the term of this patent is extended or adjusted under 35 U.S.C. 154(b) by 316 days.

(21) Appl. No.: 10/423,862

(22) Filed: Apr. 28, 2003

(65) Prior Publication Data

US 2003/0200709 A1 Oct. 30, 2003

Related U.S. Application Data

(60) Provisional application No. 60/375,418, filed on Apr. 26, 2002.

(51) Int. Cl.
*E04B 7/18* (2006.01)

(52) U.S. Cl. ..... 52/200; 52/28; 52/173.3; D25/52

(58) Field of Classification Search ..... 52/200, 52/28, 173.3, 72; 362/147, 275, 367, 360; D25/52; 359/592–598
See application file for complete search history.

(56) References Cited

U.S. PATENT DOCUMENTS

| | | | | |
|---|---|---|---|---|
| 5,546,712 | A * | 8/1996 | Bixby | 52/200 |
| 5,655,339 | A * | 8/1997 | DeBlock et al. | 52/200 |
| 5,896,713 | A * | 4/1999 | Chao et al. | 52/200 |
| 6,035,593 | A * | 3/2000 | Chao et al. | 52/200 |
| 6,256,947 | B1 * | 7/2001 | Grubb | 52/200 |
| 6,871,459 | B2 * | 3/2005 | Van Dame | 52/200 |
| 2003/0061775 | A1 * | 4/2003 | Rillie | 52/200 |
| 2003/0066254 | A1 * | 4/2003 | DeBlock | 52/200 |
| 2003/0079422 | A1 * | 5/2003 | Bracale | 52/200 |
| 2003/0126811 | A1 * | 7/2003 | Van Dame | 52/200 |

* cited by examiner

*Primary Examiner*—Carl D. Friedman
*Assistant Examiner*—Chi Q. Nguyen
(74) *Attorney, Agent, or Firm*—Banner & Witcoff, Ltd.

(57) ABSTRACT

A roof-mounted skylight having a plurality of distribution tubes. Natural light is directed through a dome on the skylight into a light collector box attached to the dome. The plurality of distribution tubes are coupled to the collector box and distribute natural light passed through the dome to rooms within the building.

6 Claims, 8 Drawing Sheets

FIGURE 4A
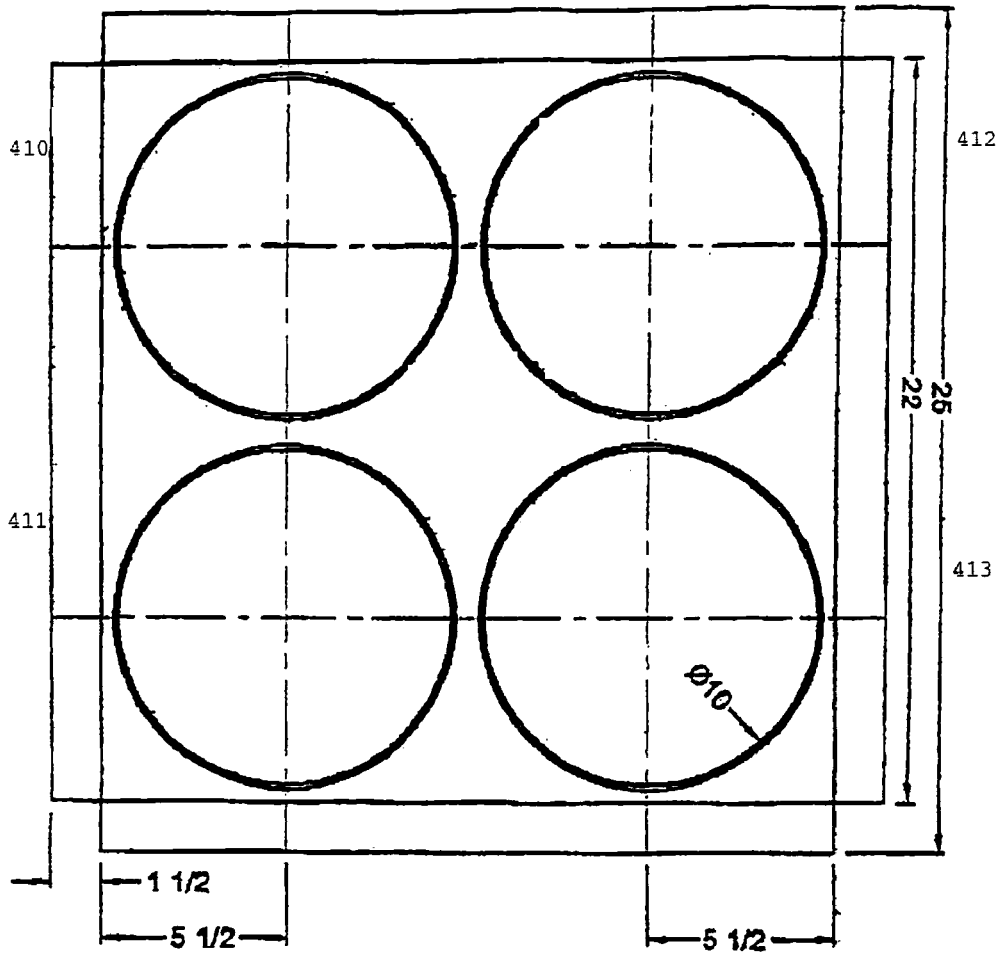
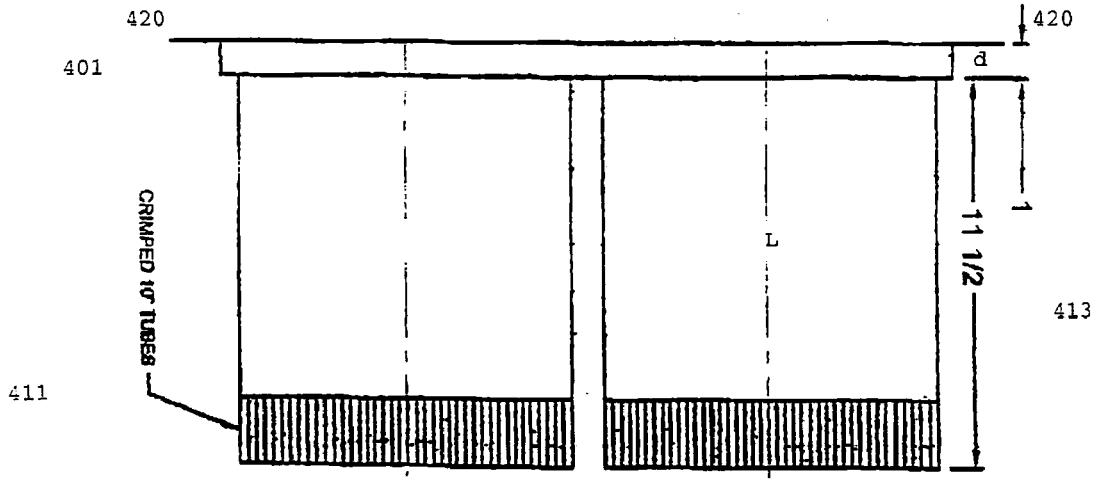
FIGURE 4B

MULTI-TUBE SKYLIGHT

CROSS REFERENCE TO RELATED APPLICATION

The present application claims priority to Provisional Application No. 60/375,418 filed Apr. 26, 2002 and entitled "Multi-Tube Skylight", said application being incorporated herein by reference.

BACKGROUND OF THE INVENTION

The present invention generally relates to the field of natural lighting systems and more particularly, is directed to a skylight having a plurality of distribution channels or tubes for directing natural light to a plurality of rooms within a building.

The design and use of lighting systems in a building or home is often the subject of much consideration and attention. Not only must the lighting system meet the illumination needs of the room, the system must also complement the mode and desired ambiance.

In recent years, the introduction of natural light into a room has become increasingly popular. Driven by economic and artistic taste, natural light is cost free, more pleasing to the eye and more relaxing to room occupants than man-made light. In addition, natural light can enhance the atmosphere of a room in ways not possible with man-made light. Living plants also respond better to natural light than they do to most types of man-made light.

Natural light often is introduced into an interior room of a home or building by way of a skylight. Skylights usually comprise a transparent dome or cover mounted on the roof of the home. A reflective tube is connected to the dome and is routed to a diffuser mounted in the ceiling of the room to be lighted. Thus, natural light striking the dome reflects downward through the tube and into the room through the diffuser.

A number of styles and designs exist in the art for various embodiments of a skylight. The idea of using a tube made of reflective material to deliver natural light into a building or room of a home is not new. Each of the current designs, however, is limited to a single output for each dome or bubble on the roof. As the number of skylights desired increases so does the labor cost, material costs and possibility for leaks and subsequent water damage. Accordingly, there is a need for a skylight of multi-tube design which minimizes the number of cutouts in the roof, and thus the potential for leaking.

SUMMARY OF THE INVENTION

It is an objective of the present invention to provide a multi-tube skylight which can be used to illuminate a plurality of rooms in a building;

It is another objective of the present invention to provide a multi-tube skylight which is economical to build and install; and It is a still further objective of the present invention to provide a multi-tube skylight which can be readily installed and which can serve as a source of natural light for a plurality of rooms in a building.

BRIEF DESCRIPTION OF THE DRAWINGS

The present invention will be better understood with reference to the following description in conjunction with the accompanying drawings in which:

FIG. 4A illustrates a top view of a multi-tube skylight in accordance with the present invention;

FIG. 4B illustrates a side view of the embodiment shown in FIG. 4A;

BRIEF DESCRIPTION OF THE PREFERRED EMBODIMENT

Figure 1:
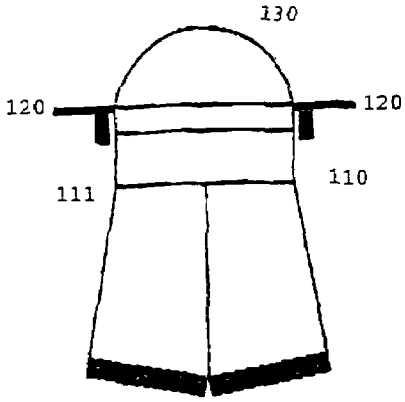
FIG. 1 illustrates a side view of a multi-tube skylight in accordance with one embodiment of the present invention.
Figure 5:
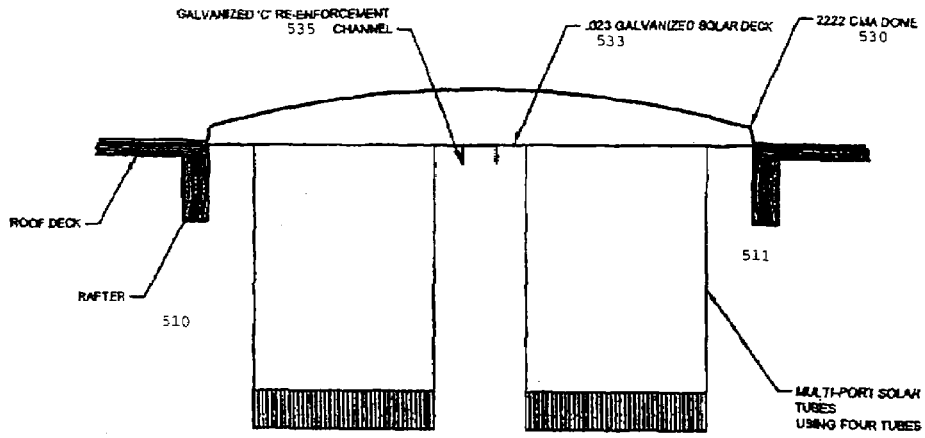
FIG. 5 illustrates a side view of an embodiment of a multi-tube skylight mounted in a roof cutout in accordance with the present invention.
Figure 6:
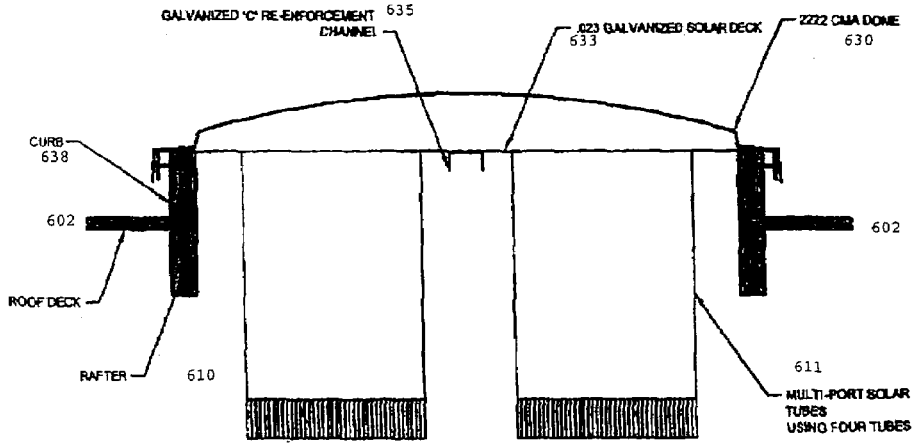
FIG. 6 illustrates a side view of another embodiment of a multi-tube skylight mounted in a roof cutout in accordance with the present invention.

The present invention is a new tubular skylight system that minimizes the number of roof openings and delivers an even amount of light to multiple locations inside a building or rooms of a home. The design includes the following parts:

1. roof dome or bubble
2. solar port
3. light delivery system
4. interior diffusion system The roof dome, or bubble is configured to allow the passage of light into the multi-tube skylight system, as can be seen in FIG. 1. Referring to the embodiment shown in FIG. 1, light travels through the roof dome 130 and passes through the tubes 110, 111. In the embodiments shown in FIGS. 5, 6, 7, 8, 10 and 11, the roof dome includes a 2222 CMA dome. The roof dome can be mounted to the roof deck on the exterior of a home, for example, as shown in FIGS. 5 and 6. FIG. 5 shows a roof dome 530 mounted on a roof deck 502. FIG. 6 shows a roof dome 630 mounted on a curb 638 disposed adjacent to a roof deck 602.

In addition to a roof dome, the multi-tube skylight also includes a solar port. The purpose of the solar port is to allow as much solar light as possible to be captured by the light delivery system for delivery into the home. Also, it is important that the light delivered to the interior be as consistent as possible in intensity from room to room throughout the day. The solar port can include a box, as can be seen in FIGS. 2, 3, 4A and 4B. The box may be either square, for example, as in the box 201 of the embodiment shown in FIG. 2, or rectangular, for example, as in the box 301 of the embodiment shown in FIG. 3. The solar port may also include a flat sheet of galvanized steel that is reinforced with a galvanized "c" channel, for example, the embodiment of FIG. 5 includes a 0.023 galvanized solar deck 533 with a galvanized "c" re-enforcement channel 535.

The light delivery system of the present invention includes a plurality of tubes, as can be seen in FIGS. 1–7 and 9–11. The tubes can be disposed at the top surface of the solar port. For example, in the embodiment shown in FIG. 5, the openings of the tubes 510, 511 are disposed at the top of the solar deck 533. In other embodiments, the tube can staff at the top of the curb that is attached to the roof for example, as can be seen in FIG. 6, where the openings to the tubes 610, 611 begin at the top of the curb 638. The tubes may exit the solar port at a 90 degree angle, as shown in both FIG. 5 and FIG. 6.

The design of the solar port opening can be changed to increase the amount of sunlight transmitted to the home. In one embodiment, such as Asshewnin the embodiment shown in FIG. 1, converging tubes 110, 111 at the roofline 120 maximize the size of the solar port 130 relative to the roof opening and minimize the amount of sunlight that is reflected back toward the sky. Thus, maximizing the sunlight transmitted into the home. This design is effective at reflecting sunlight down the delivery system.

Figure 2:
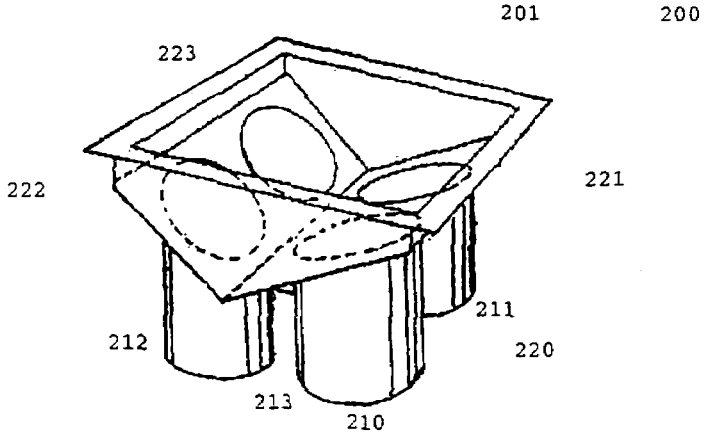
FIG. 2 illustrates a perspective view of an embodiment of a solar port design for a multi-tube skylight in accordance with the present invention.
Figure 8:
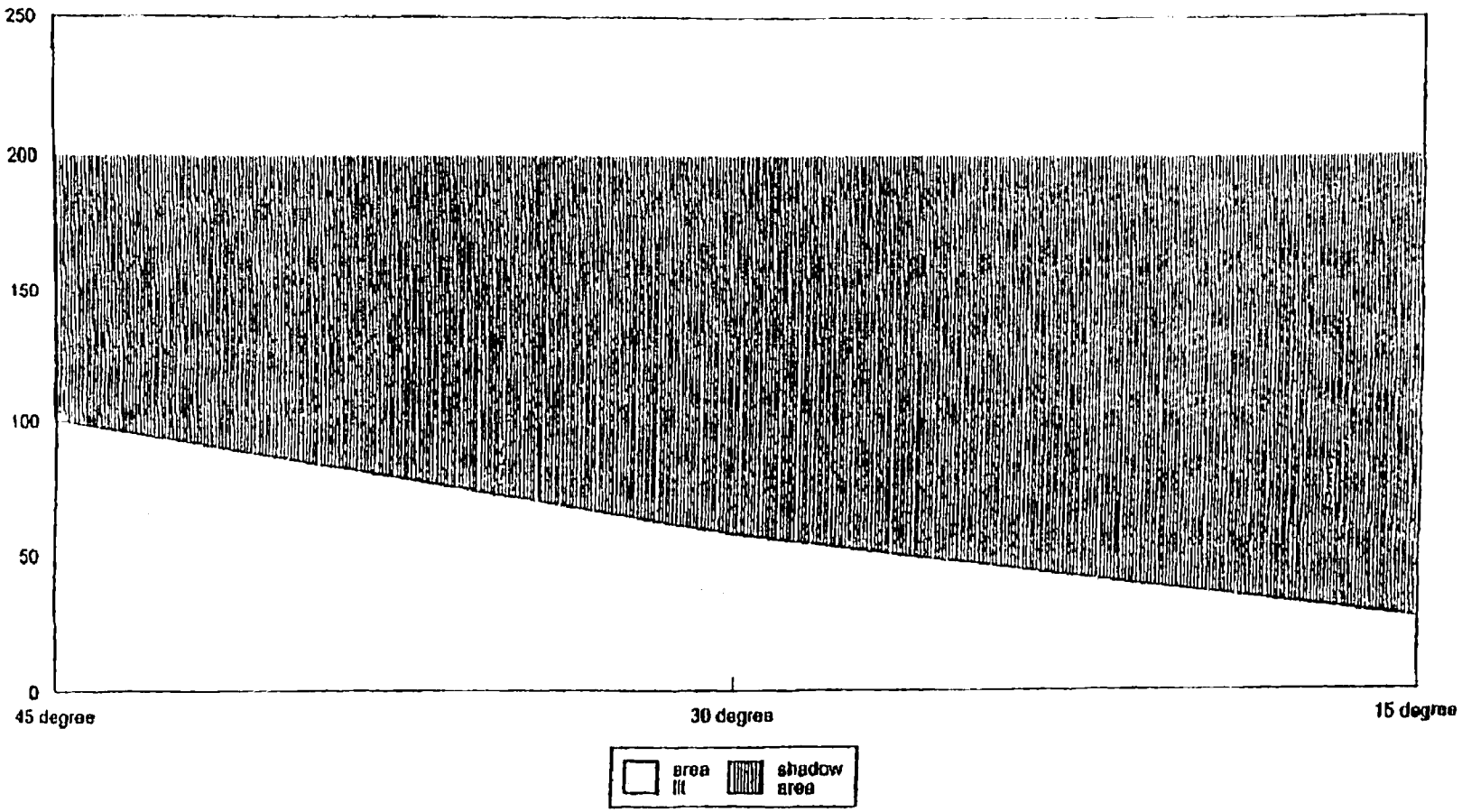
FIG. 8 is a graph that illustrates various light transmissions in accordance with the angle at which the light enters the distribution tubes in accordance with the present invention.

The size of the solar port opening can be increased by varying the angle of the opening of the tubes. FIG. 2 illustrates a box design that maximizes the opening area of the tubes 219, 211, 211, 213 that form the light delivery system 200. As can be seen in FIG. 8, the amount of light captured by the present invention for delivery into the home depends on the angle at which the light hits the tube. The tubes 210, 211, 212, 213 of the embodiment of FIG. 2 enter the box 203 at an angle A thus making the end of the tube 210, 211, 212, 213 an oval not a circle. This increases the size of the opening 220, 221, 222, 223 to the tube 210, 211, 212, 213 and allows more sunlight to be captured by the light delivery system 200. This design is effective at capturing sunlight and transmifting it to the interior of the home. In one embodiment, the box has at least two interior faces that are disposed adjacent to each other at an obtuse angle and opposite to the roof dome.

Figure 3:
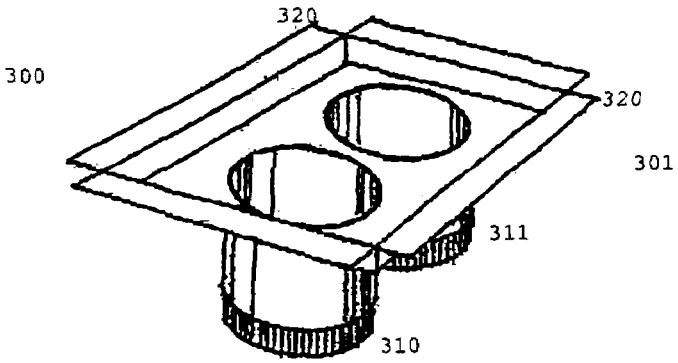
FIG. 3 illustrates a perspective view of an embodiment of a solar port design for a multi-tube skylight in accordance with the present invention.

FIGS. 3, 4A and 4B illustrate a solar port designed so that the ends of the tubes 310, 311, 410, 411, 412, 413 in the light delivery system 300, 400 are as close to the roofline 320, 420 as possible. Referring to the embodiment shown in FIG. 4A and 4B, the tube 411 is perpendicular to the surface of the box 401 and parallel to the roofline 420. As can be seen in FIGS. 3 and 4B, the tube may include a crimped end. The box may have a may have a square or rectangular configuration.

This design is effective at capturing sunlight and transmitting it to interior of the home. The shallow design of the box reduces the shadow effect of the box sides as the sun changes angles in the sky. The light level in the interior of the home remains consistent throughout the day. The rectangular or square shape of the box makes rotating the box 90 degrees for installation purposes possible without effect on the resulting light level to the interior of the home. The manufacturing of this design is not complicated and easy to adapt to multiple delivery systems.

Figure 7:
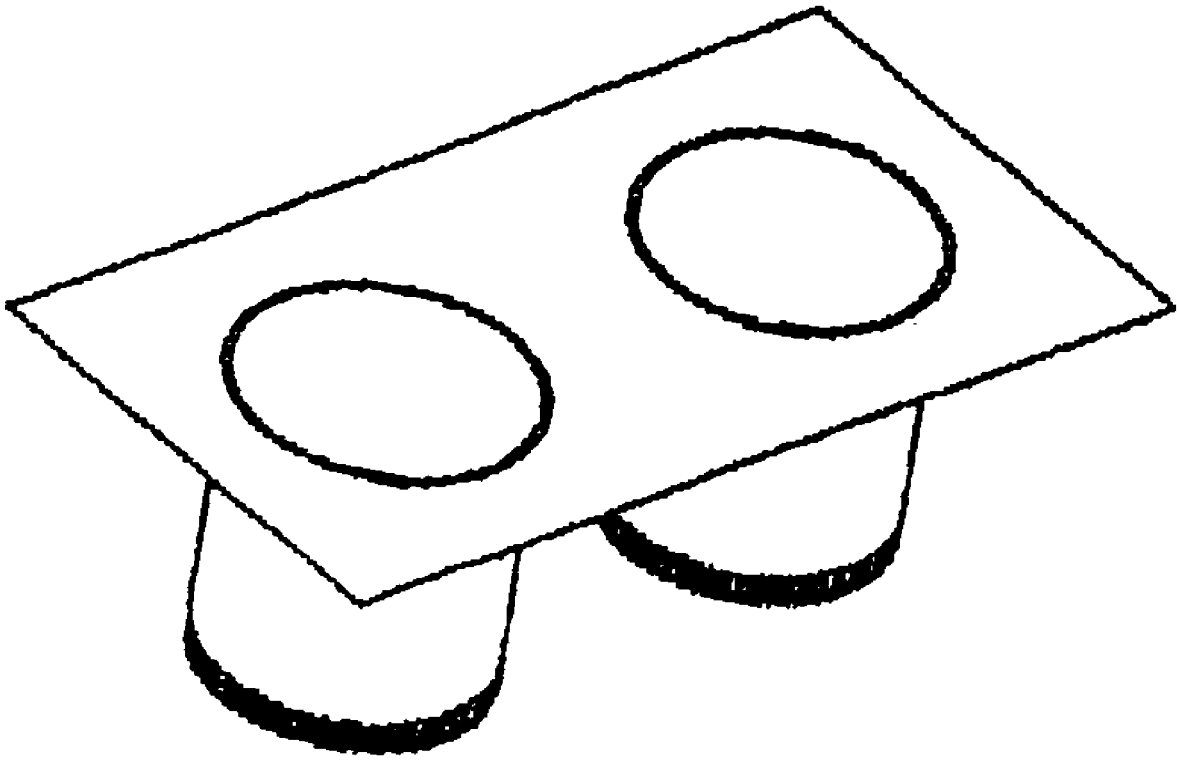
FIG. 7 illustrates a perspective view of an embodiment of a solar port design for a multi-tube skylight in accordance with the present invention.
Figure 9:
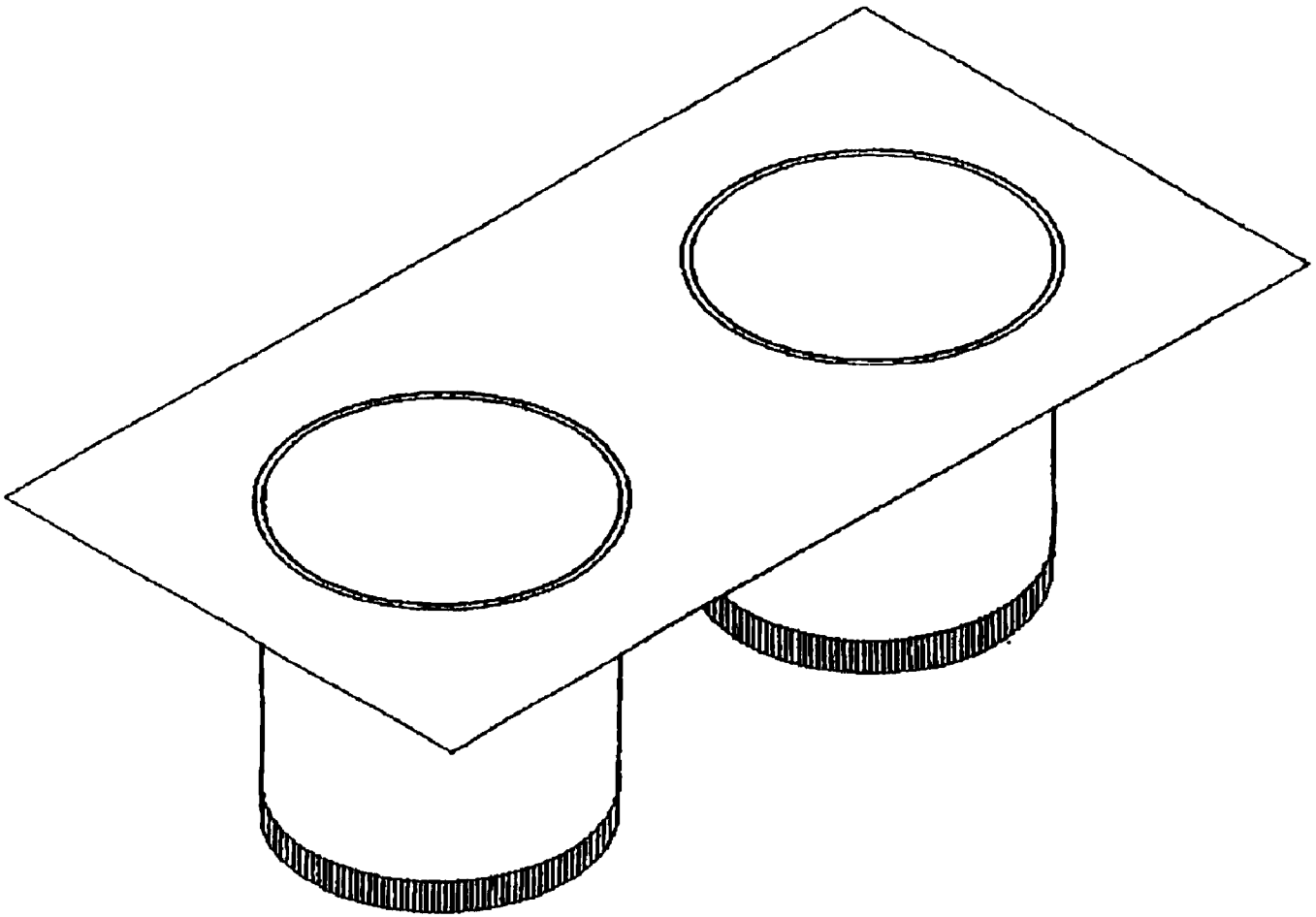
FIG. 9 illustrates a perspective view of an embodiment of a multi-tube skylight in accordance with the present invention.
Figure 10:
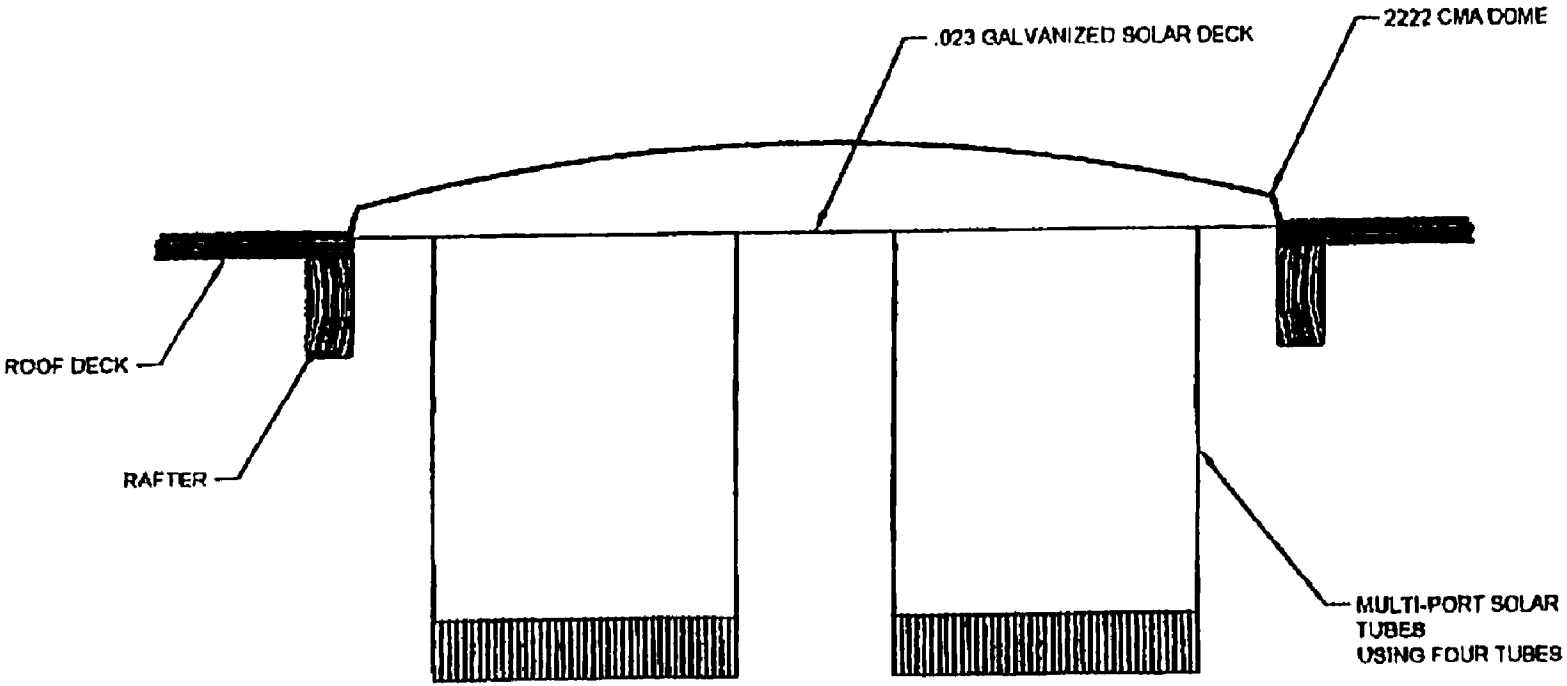
FIG. 10 illustrates a side view of an embodiment of a multi-tube skylight mounted in a roof cutout in accordance with the present invention.
Figure 11:
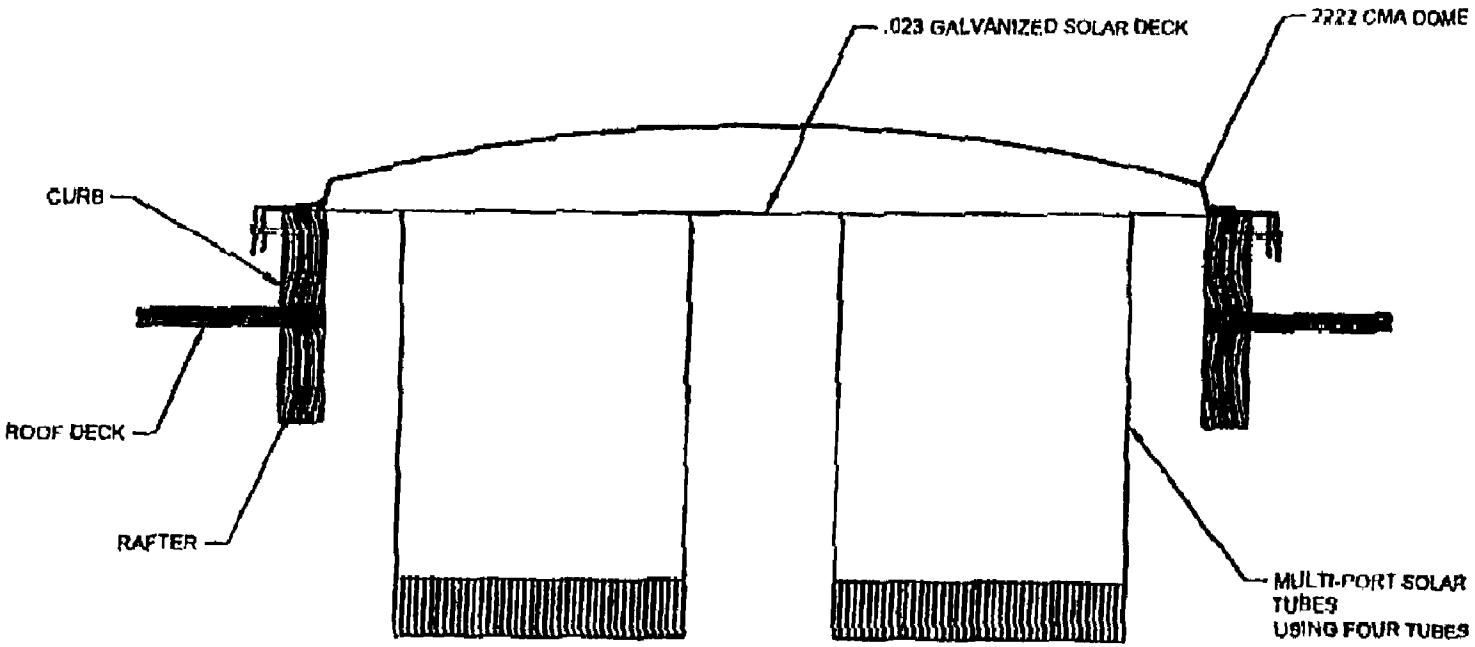
FIG. 11 illustrates a side view of another embodiment of a multi-tube skylight mounted in a roof cutout in accordance with the present invention.

The depth of the solar port may be varied to increase sunlight transmission. In FIGS. 5–7 and 9–11 the solar port (box) 301 from FIG. 3 was flattened and re-enforced with a galvanized "c" channel 535. This design eliminates any shadows created by the box. The tubes 610, 611 pass through the port in a perpendicular orientation while the port itself is parallel to the roofline or flush with the top of the curb 638 (which may not be parallel with the roof.) In one embodiment, the solar port is rectangular in shape, as shown in the embodiments of FIG. 7 and FIG. 9. As shown in FIG. 5 and FIG. 6, the tubes 510, 511, 610, 611 can include multi-port solar tubes using four tubes. This design maximizes the amount of direct light that enters the tubes as is shown in the data below. Also see the graph in FIG. 8.

| Light Angle | Area Lit (Sq. in) | Shadow (Sq. in) | Total (Sq. in) |
|---|---|---|---|
| 45° | 100 | 100 | 200 |
| 30° | 57.74 | 146.26 | 200 |
| 15° | 26.8 | 173.2 | 200 |

This design appears to be the most effective at delivering direct light from all angles tested. The design is simple and uncomplicated making manufacturability good. Adaptation to multi opening is easily accomplished.

In accordance with the present invention, all joints in the system are sealed with either tape, sealant or a gasket. It is important that humidity be kept out of the system. The lens on the ceiling is sealed with a gasket, the tubes are sealed with duct tape and the dome is sealed with sealant. Also, the dome itself is a sealed unit.

The solar port shown in FIG. 5 is not a box but rather a flat sheet of galvanized steel. The top of the reflective tube 510, 511 starts at the top surface of the galvanized sheet 533. Referring to the features shown in FIG. 4B, as the depth d of the box 401 is decreased the performance increased. The features shows decreasing the depth of the box to zero thus maximizing that aspect of the design.

Referring to FIGS. 5–7 and 9–11, the tubes start at the top surface of the solar port. Therefore, relative to the roof, the tube can start at the top of the curb that is attached to the roof. For example, FIG. 6 shows an embodiment where a tube 610 begins at the top of a curb 638 attached to the roof 602.

The solar port can be either square or rectangular depending on the configuration. These shapes are easier to install than other shapes because the opening can be cut without the use of templates.

All of the tubes exit the solar port at 90 degrees. They converge at the solar port but not into each other.

While there have been described what are at present considered to be preferred embodiments of the present invention, it will be obvious to those skilled in the art that various changes and modifications may be made therein without departing from the invention, and it is therefore intended to cover all such changes and modifications as fall within the spirit and scope of the appended claims.

We claim:

1. A multi-tube skylight adapted for providing natural light to a plurality of rooms in a home, comprising:

a roof dome including a material providing for the passage of natural light and configured to enclose a single opening disposed on the exterior of a building;

a solar port including a box having a plurality of interior faces, wherein at least two of the plurality of interior faces are disposed adjacent to each other at an obtuse angle and opposite the roof dome, the at least two of the plurality of interior faces being configured to communicate with a plurality of tubes;

the plurality of tubes having at least one open end disposed opposite the roof dome, wherein the open end is disposed at an angle relative to the obtuse angle formed by the at least two adjacent faces, the plurality of tubes being configured to transmit light received from the solar port to an interior diffusion system, wherein the interior diffusion system is configured to allow natural light to pass into a building.

2. The multi-tube skylight of claim 1, wherein the plurality of interior faces is four faces, and the plurality of interior faces is configured such that a first face and a second face is disposed opposite to the roof dome, wherein the first face is disposed adjacent to and at an angle to the second face.

3. The multi-tube skylight of claim 2, wherein the first face and the second face further includes at least one opening defined by a tube.

4. The multi-tube skylight of claim 1, wherein the plurality of tubes includes four tubes.

5. The multi-tube skylight of claim 1, wherein the plurality of interior faces includes a first face and a second face, wherein the first face is disposed adjacent to the second face at an angle relative to the first face, the first face and second face being disposed opposite to the roof dome.

6. The multi-tube skylight of claim 5, wherein the plurality of tubes further include at least one open end, wherein the open end is disposed at an angle relative to the angle formed by the first face and the second face.

* * * * *